US007380309B2

(12) United States Patent
Forsythe

(10) Patent No.: US 7,380,309 B2
(45) Date of Patent: Jun. 3, 2008

(54) KNOB ATTACHMENT ASSEMBLY

(75) Inventor: Alan K. Forsythe, Kent, WA (US)

(73) Assignee: GT Development Corporation, Seattle, WA (US)

( * ) Notice: Subject to any disclaimer, the term of this patent is extended or adjusted under 35 U.S.C. 154(b) by 0 days.

(21) Appl. No.: 10/688,579

(22) Filed: Oct. 17, 2003

(65) Prior Publication Data

US 2005/0081331 A1 Apr. 21, 2005

(51) Int. Cl.
*G05G 1/00* (2006.01)
*G05G 1/02* (2006.01)
*G05G 1/12* (2006.01)

(52) U.S. Cl. ..... 16/110.1; 16/429

(58) Field of Classification Search ..... 16/110.1, 16/111.1, 412, 413, 415, 417, 422, 433, 441, 16/114 R, DIG. 30, DIG. 41, 118, 121; 292/347, 292/349, 336.3, 348, 354–356, DIG. 53, 292/DIG. 60, DIG. 31; 188/72.7, 265; 74/545, 74/548, 544, 546
See application file for complete search history.

(56) References Cited

U.S. PATENT DOCUMENTS

| | | | | | |
|---|---|---|---|---|---|
| 291,687 | A * | 1/1884 | Clark | 292/347 |
| 334,937 | A * | 1/1886 | Comstock | 292/347 |
| 1,333,998 | A * | 3/1920 | Shook | 123/185.13 |
| 2,171,361 | A * | 8/1939 | Gits et al. | 16/441 |
| 3,188,124 | A * | 6/1965 | Pestka et al. | 403/383 |
| 3,193,312 | A * | 7/1965 | Ehner | 403/354 |
| 3,887,963 | A * | 6/1975 | Harmon et al. | 16/441 |
| 3,909,878 | A * | 10/1975 | Natinsky | 16/441 |
| 3,994,608 | A * | 11/1976 | Swiderski et al. | 403/372 |
| 4,189,248 | A * | 2/1980 | Sully | 403/11 |
| 4,418,637 | A * | 12/1983 | Heermans | 116/70 |
| 4,835,816 | A * | 6/1989 | Graef | 16/422 |
| 5,305,660 | A * | 4/1994 | Hasegawa | 74/553 |
| 5,407,293 | A * | 4/1995 | Crainich | 403/322.1 |
| 5,575,516 | A * | 11/1996 | Baumgarten | 292/353 |
| 5,676,023 | A * | 10/1997 | Masuda et al. | 74/538 |
| 5,857,242 | A * | 1/1999 | Pizzo et al. | 16/441 |
| 5,882,053 | A * | 3/1999 | Bekins et al. | 292/336.3 |
| 6,058,797 | A * | 5/2000 | Konig et al. | 74/523 |
| 6,457,208 | B1 * | 10/2002 | Keith | 16/422 |
| 6,615,688 | B2 * | 9/2003 | Wessel | 74/551.9 |
| 6,709,188 | B2 * | 3/2004 | Ushimaru | 403/329 |

FOREIGN PATENT DOCUMENTS

| | | |
|---|---|---|
| DE | 33 10496 A1 | 9/1984 |
| EP | 1 300 744 A2 | 4/2003 |
| GB | 1176015 A | 1/1970 |

* cited by examiner

*Primary Examiner*—Robert J Sandy
(74) *Attorney, Agent, or Firm*—The Ollila Law Group LLC

(57) ABSTRACT

A knob attachment assembly formed in accordance with one embodiment of the present invention is provided. The knob attachment assembly includes a control device housing (105) and an actuation member (106) coupled to the control device housing, the actuation member including a first engagement surface (140). The knob attachment assembly further includes a gripping device (104) including a first interference surface (158), the gripping device being selectively coupled to the actuation member and positionable between a locked position, wherein the gripping device is coupled to the actuation member by interference of the first engagement surface and the first interference surface, and an unlocked position, wherein the gripping device is removable from the actuation member.

33 Claims, 5 Drawing Sheets

KNOB ATTACHMENT ASSEMBLY

FIELD OF THE INVENTION

This invention relates generally to knob attachment assemblies, and more particularly to knob attachment assemblies having a knob adjustable in orientation.

BACKGROUND OF THE INVENTION

Knob attachment assemblies have been long used to couple a knob to control a device, such as a switch, valve, cable, etc. The knob may then be selectively manipulated to provide input control to a piece of machinery. For instance, a knob of a knob attachment assembly may control a valve, such as a valve of a vehicle's braking system. Often the control devices are mounted within control panels, wherein the control device is mounted to a backside of the control panel and an actuation member passes through the control panel. A knob or handle is coupled to the distal end of the actuation member on the front side of the control panel. The handle allows a user to grip the actuation member and move the actuation member to actuate the control device.

Although previously developed knob attachment assemblies are effective, they are not without their problems. For instance, previously developed knob attachment assemblies may permit the handle to be installed in only one orientation relative to the control panel. Thus, the knob or handle cannot be reoriented into a second position to correct any error in the orientation of the knob once installed. For instance, if the handle includes indicia indicating the function of the knob, such as the word "BRAKE," and during installation, an error is made such that the indicia is oriented incorrectly, i.e. upside down, the handle cannot be reoriented to correct the error. Or, if correctable, the orientation can only be corrected through extensive labor, such as by obtaining access behind the control panel to reorient the control device. Others require screwing the handle onto the actuation member, requiring a number of turns to fully engage the handle, while still not orientating indicia in a reproducible orientation. Still others provide detents to orient indicia, but require many turns of the handle to install.

Thus, there exists a need for a knob attachment assembly having a handle that is selectively orientable and lockable in a variety of orientations, that may be installed with only a partial turn, and is easily removable.

SUMMARY OF THE INVENTION

In accordance with one embodiment of the present invention, a knob attachment assembly is provided. The knob attachment assembly includes a control device and an actuation member coupled to the control device, the actuation member including a first engagement surface. The knob attachment assembly further includes a gripping device including a first interference surface. The gripping device is selectively couplable to the actuation member and is positionable between a locked position, wherein the gripping device is coupled to the actuation member by interference of the first engagement surface with the first interference surface, and an unlocked position, wherein the gripping device is removable from the actuation member.

In accordance with another embodiment of the present invention, a knob attachment assembly is provided. The knob attachment assembly includes a control device and an actuation member coupled to the control device and having a first projection with a first engagement surface. The knob attachment assembly further includes a gripping device having a first protrusion with a first interference surface, wherein the gripping device is adapted to be selectively keyed upon the actuation member in either a first orientation or a second orientation by selective interaction of the first projection with the first protrusion. The gripping device is selectively couplable to the actuation member and is positionable between a locked position, wherein the gripping device is coupled to the actuation member by interference of the first engagement surface with the first interference surface, and an unlocked position, wherein the gripping device is selectively removable from the actuation member.

In accordance with still another embodiment of the present invention, a knob attachment assembly is provided. The knob attachment assembly includes an actuation member having a limit stop and a first projection. The knob attachment assembly further includes a gripping device having a first protrusion and a locking member coupled to either the actuation member or the gripping device. The gripping device is adapted to be selectively keyed upon the actuation member in either a first orientation or a second orientation by selectively interfacing of the first projection with the first protrusion. The gripping device is selectively couplable to the actuation member and is positionable between a locked position, wherein the gripping device is coupled to the actuation member by engagement of the first protrusion against the limit stop, and engagement of the locking member against the first projection or the first protrusion, and an unlocked position, wherein the gripping device is selectively removable from the actuation member.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
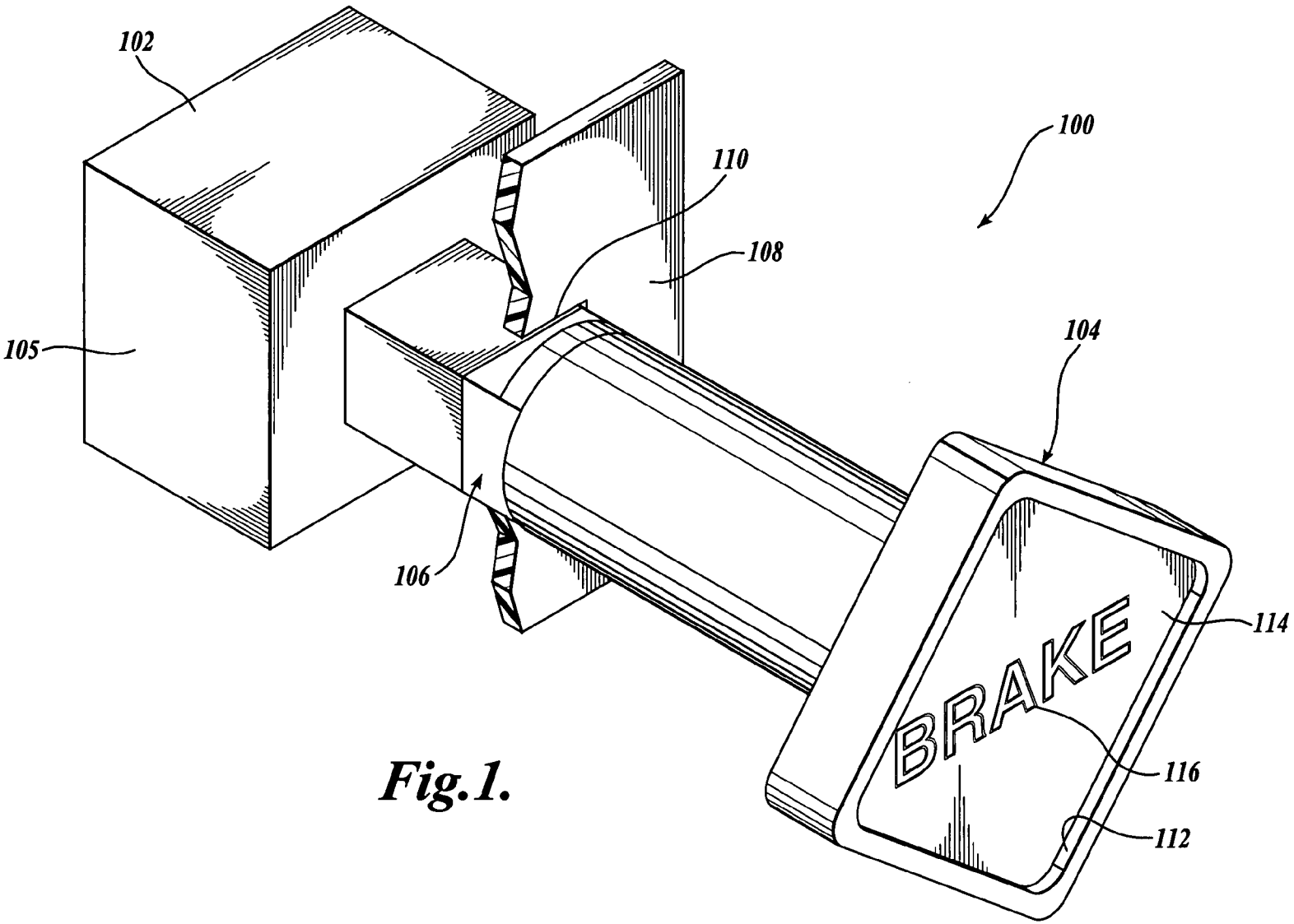
FIG. 1 is a perspective view of one embodiment of a knob attachment assembly formed in accordance with the present invention, the knob attachment assembly including a control device located on a backside of a control panel, an actuation member passing through the control panel, and a gripping device coupled to a distal end of the actuation member on the front side of the control panel, the gripping device having a faceplate attached thereto with the word "BRAKE" affixed thereon.

FIGS. 1-4 illustrate one embodiment of a knob attachment assembly 100 formed in accordance with the present invention. Referring to FIG. 1, the knob attachment assembly 100 includes a control device 102 and a gripping device 104. An actuation member 106 extends between and couples the gripping device 104 to a housing 105 of the control device 102. The knob attachment assembly 100 will be described for illustrative purposes as implemented in cooperation with a braking system of a vehicle.

Although the embodiments of the present invention are described as implemented with a braking system of a vehicle, those skilled in the art will appreciate that the disclosed embodiments of the knob attachment assembly 100 are illustrative in nature and should not be construed as limited to application with a braking system or with a vehicle, and may be used in any situation where the ability to couple a gripping device of a knob attachment assembly to a control device is desirable. Further, although a specific control device is described and illustrated, it should be apparent to those skilled in the art that the control device is not limited to the illustrated embodiment and may be any well known switch, valve, cable, etc., currently known or yet to be developed. Thus electrical, mechanical, or other types of control devices, are suitable for use with and within the spirit and scope of the present invention.

In the illustrated embodiment, the actuation member 106 extends through a control panel 108, the control panel 108 representing a dash console of the vehicle (not shown). The control device 102 is coupled by well known means (not shown) to a backside of the control panel 108. The actuation member 106 is coupled to the control device 102 and passes through an aperture 110 in the control panel 108 such that a distal end of the actuation member 106 is disposed on a front side of the control panel 108.

The gripping device 104 is coupled to the distal end of the actuation member 106. The gripping device 104 is adapted to receive an input force by a user. The actuation member 106 transfers the input force to the control device 102, configuring the control device 102 between a first position and a second position. When the control device 102 is in the first position, pressurized air is supplied to a braking system (not shown) to actuate a set of brakes into a locked or engaged position. When the control device 102 is in the second position, air is released from the braking system to release the brakes from the locked or engaged position.

The distal end of the gripping device 104 includes a recess 112. The recess 112 is adapted to receive a faceplate 114, the faceplate 114 having indicia 116 marked thereon. The indicia 116 may take many suitable forms, such as printed words, symbols, letters, characters, textured surfaces, Braille, light, etc. For illustrative purposes, the indicia 116 depicted in FIG. 1 includes the word "BRAKE" to indicate generally the function of the control device 102 to which the gripping device 104 is coupled.

The gripping device 104 of the illustrated embodiment is in the form of a knob, however it should be apparent to those skilled in the art that the gripping device 104 may come in many suitable forms. More specifically, the gripping device 104 may be any device which aids in the gripping of the actuation member 106 by a user, such as a handle, a textured surface, one example being a knurled cylinder, etc. The gripping device 104 is formed from any suitable material, one suitable example being plastic.

Figure 2:
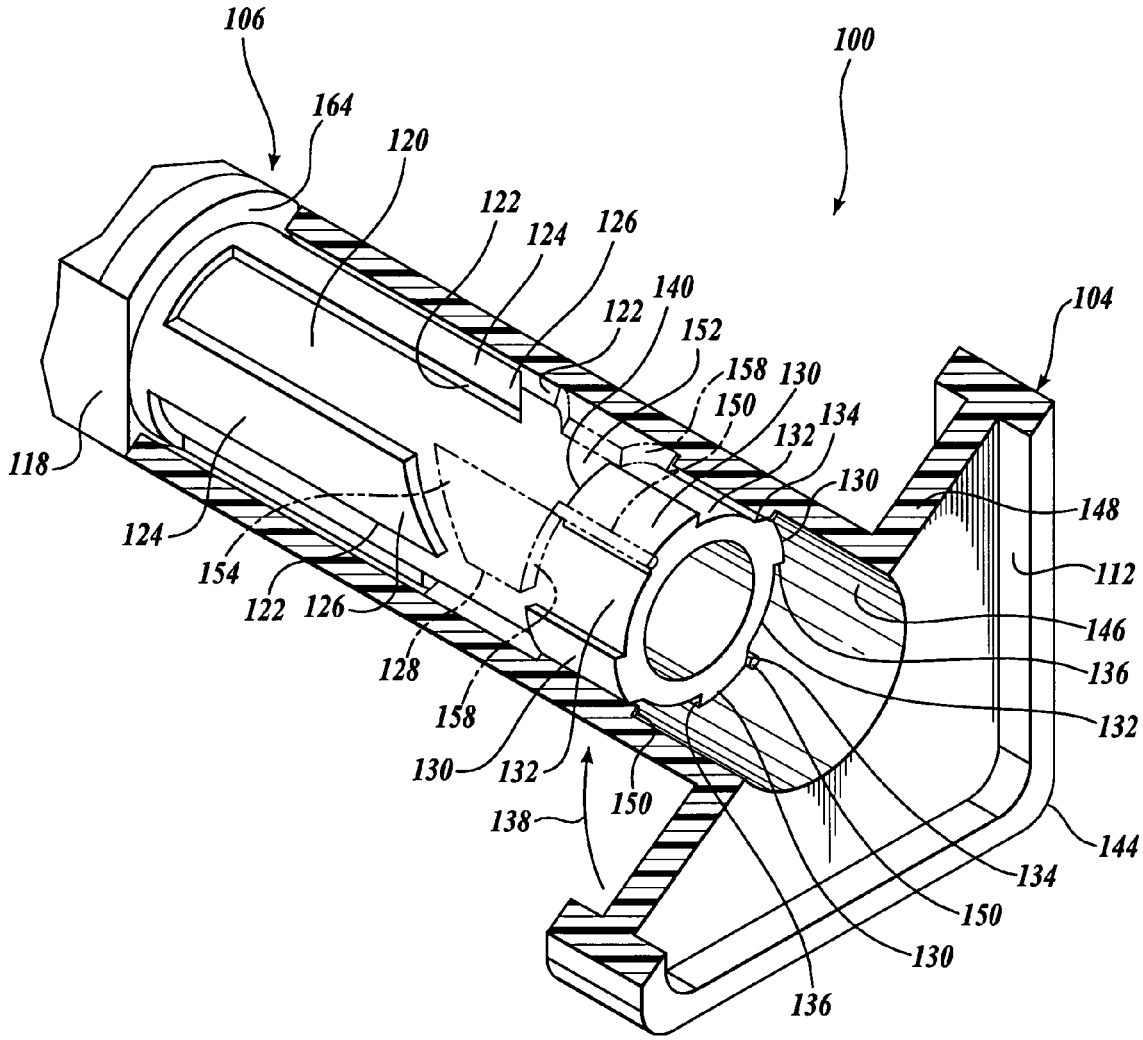
FIG. 2 is a partial perspective view of the knob attachment assembly of FIG. 1 depicted with the gripping device shown in cross-section, the cross-sectional cut taken through a center axis of the gripping device, wherein a series of protrusions and locking members disposed on the portion of the gripping device which has been cut away are shown in phantom, and showing a series of projections and limit stops disposed on the actuation member, wherein the gripping device is shown in an unlocked position wherein the gripping device is selectively removable from the actuation member, and wherein the faceplate has been removed for clarity.
Figure 4:
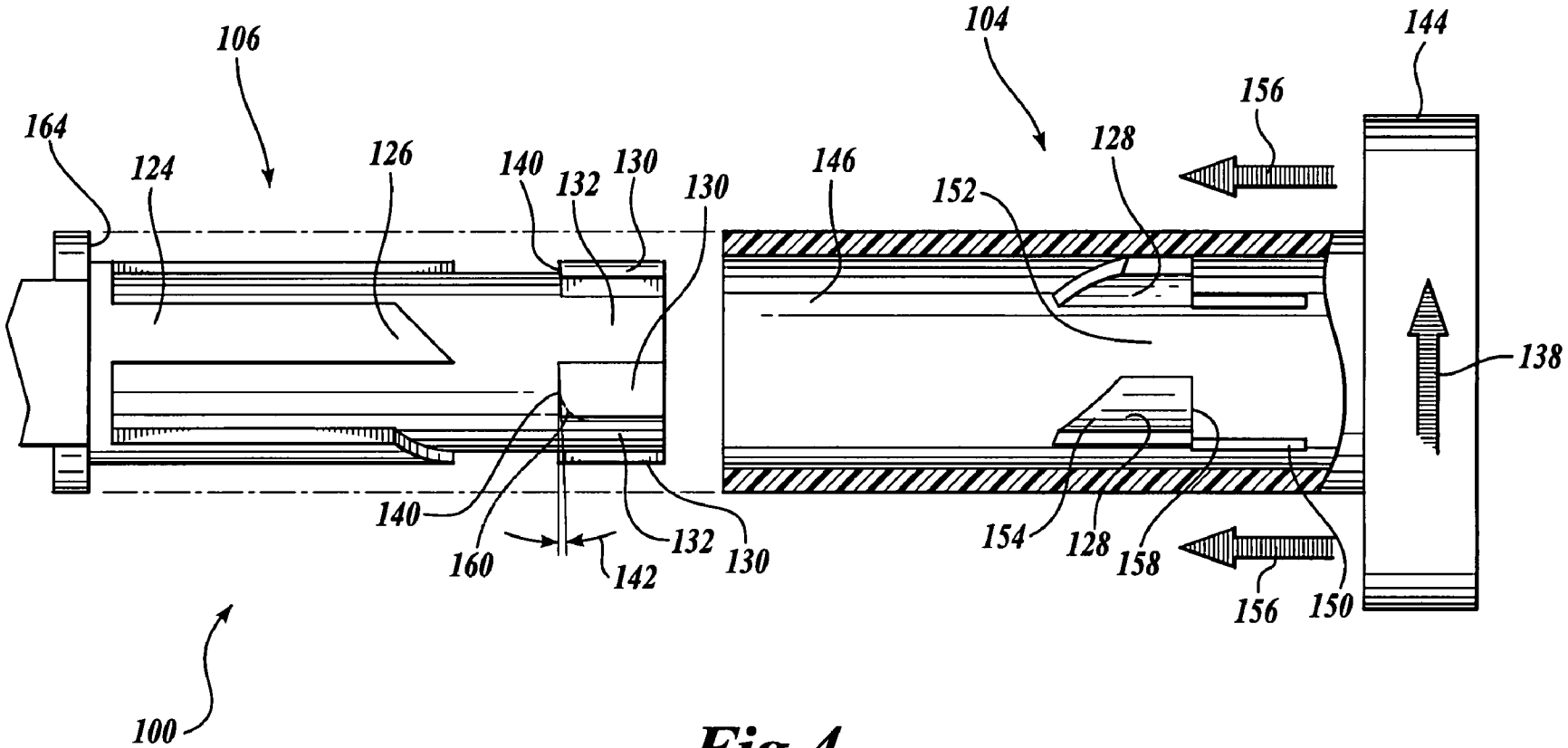
FIG. 4 is a partial exploded elevation view of the knob attachment assembly of FIG. 1, wherein a portion of the gripping device has been removed to show the locking members and protrusions disposed in an inner cavity of the gripping device.

Referring to FIGS. 2 and 4, the components of the actuation member 106 will now be described in further detail. The actuation member 106 includes a base portion 118 coupled to a proximal end of a cylindrically shaped main body 120. Disposed on the main body are four limit stops 122 (three shown) spaced at 90 degree intervals about the main body 120. Each limit stop 122 is formed by a radially oriented and longitudinally aligned edge of a platform 124. Each platform 124 is a longitudinally aligned structure extending radially outward from the outer surface of the main body 120 at a uniform height and having a generally constant width. The distal end 126 of each platform 124 is truncated, tapering the distal end 126 to a point. The tapering of the distal end 126 of each platform 124 provides clearance for a series of distal ends 154 of a plurality of protrusions 128 disposed on the gripping device 104, as will be described in further detail below.

Also disposed on the main body 120 are four projections 130 spaced at 90 degree intervals about the main body 120. Each projection 130 is a longitudinally aligned structure extending radially outward from the outer surface of the main body 120 at a uniform height and having a constant width. Disposed between each pair of adjacent projections 130 is a channel 132. Each channel 132 has a width selected to receive the width of one of the protrusions 128 disposed on the gripping device 104. Each projection 130 includes two longitudinally oriented sidewalls 134 and 136. Of note, the sidewalls referenced by numeral 134 are disposed on the leading edge of each projection 130 from the perspective of one rotating about the actuation member 106 in the direction indicated by arrow 138. The sidewalls referenced by numeral 136 are disposed on the trailing edge of each projection 130 from the perspective of one rotating about the actuation member 106 in the direction indicated by arrow 138.

The leading sidewall 134 of each projection 130 may be inclined from a radial plane, i.e. a plane bisecting the center axis of the actuation member 106, such that the tops of the sidewalls 134 are located further in the direction of arrow 138 than the bases of the sidewalls 134. The significance of the inclining of sidewalls 134 will be described in further detail below. The sidewalls 134 are preferably inclined from a radial plane at an angle of about 30 degrees or greater to an angle of about 60 degrees, with a preferred angle of about 45 degrees.

Each projection 130 also includes an engagement surface 140. Each engagement surface 140 is inclined slightly with respect to a laterally oriented plane. More specifically, each engagement surface 140 is inclined relative to a laterally oriented plane by a selected separation angle 142 (See FIG. 4). The separation angle may range between greater than about 1 degree and about 10 degrees, with a preferred angle of about 3 degrees.

Although the engagement surfaces 140 are shown as linear, planar members, it should be apparent to those skilled in the art that the engagement surfaces 140 may be arcuate in shape, textured, contain a ball and detent locking system, etc. For instance, in one alternate version of the embodiment depicted in FIGS. 1-4, a leading corner of the engagement surface is shaped to include a bevel 160 to facilitate the meeting and engagement of the engagement surfaces 140 with the interference surfaces 158 during operation. The bevel 160 is shown in phantom in FIG. 4 on one of the engagement surfaces 140.

Still referring to FIGS. 2 and 4, the components of the gripping device 104 will now be described in further detail. The gripping device 104 includes a knob 144 coupled to a cylindrically shaped main body 146. The knob 144 includes the recess 112 mentioned above, the recess 112 adapted to receive the faceplate, which has been removed in FIGS. 2-4 for clarity. The knob 144 includes a generally square shaped panel 148 extending radially outward from the main body 146. The panel 148 permits a user to "hook" their fingers on the back side of the knob 144 and pull outward (or alternately push inward) on the knob 144 to actuate the knob attachment between the first and second positions. Alternately, the user may grip and rotate the knob 144 about the longitudinal axis of the gripping device 104 to actuate the knob attachment between the first and second positions.

Disposed on the main body 146 are four longitudinally oriented locking members 150 spaced at 90 degree intervals about the main body 146. Each locking member 150 is formed by extending inward from the inner surface of the main body 146 a longitudinally oriented rib, or elongate rounded structure. The locking members 150 are of a selected height and have a length that substantially matches the longitudinal length of the projections 130. The height of the locking member 150 is selected to manipulate the locking force applied by the locking members 150 upon the projections 130 when the gripping device 104 is in the locked position. Moreover, the greater the height of the locking member 150, the greater the applied locking force, the shorter the height of the locking member 150, the less the applied locking force, as should be apparent to those skilled in the art from the below description.

Also disposed on the main body 146 are four protrusions 128 spaced at 90 degree intervals about the main body 146. Each protrusion 128 is a longitudinally aligned structure extending radially inward from the inner surface of the main body 146 at a uniform height and having a constant width. Disposed between each pair of adjacent protrusions 128 is a channel 152. Each channel 152 has a width selected to receive the width of the projections 130 disposed on the actuation member 106. The proximal end 154 of each protrusion 128 is truncated, tapering the proximal end 154 to a point. The tapering of the proximal end of each protrusion 128 provides clearance for the distal ends 126 of the platforms 124, as will be described in further detail below.

Each of the protrusions 128 include a laterally oriented distal edge, referred to as an interference surface 158. When the gripping device 104 is rotated from the unlocked position to the locked position, the interference surfaces 158 engage the engagement surfaces 140 in an interference fit arrangement. Due to the separation angle 142 (See FIG. 4) present between the interference surfaces 158 and the engagement surfaces 140, the further the gripping device 104 is rotated in the direction of arrow 138, the more resistance to rotation is created by the "increased engagement" of the interference surfaces 158 with the engagement surfaces 140. By varying the magnitude of the separation angle, the resistance force generated by the interference fit of the interference surfaces 158 with the engagement surfaces 140 may be manipulated. For instance, for more rigid materials or if decreased resistance forces are desired, smaller separation angles may be used. For more elastic materials or if increased resistance forces are desired, larger separation angles may be used.

Although for the illustrated embodiment, both the engagement surfaces 140 of the projections 130 and the interference surfaces 158 of the protrusions 128 are inclined relative to a laterally oriented plane, it should be apparent to those skilled in the art that either the interference surfaces 158 or the engagement surfaces 140 individually, may be inclined relative to a laterally oriented plane. Further still, although the engagement surfaces 140 and/or the interference surfaces 158 are described as inclined from a laterally oriented plane, it should be apparent to those skilled in the art that the engagement and/or interference surfaces may be inclined to a plane other than one laterally oriented. For instance, the engagement surfaces 140 may be located at an angle of 20 degrees from a laterally oriented plane and the interference surfaces at an angle of 20 degrees plus the selected separation angle without departing from the spirit and scope of the present invention.

The actuation member 106 may be formed from any suitable material, one example being plastic.

In light of the above detailed description of the components of the knob attachment assembly 100, the operation of the knob attachment assembly 100 will now be described. Referring to FIG. 1, during an installation phase, the control device 102 is coupled to the backside of the control panel 108 by any well known means. The actuation member 106 of the knob attachment assembly 100 protrudes through the aperture 110 in the control panel.

Referring to FIG. 4, the gripping device 104 is aligned with the actuation member 106 and moved toward the actuation member 106 in a direction indicated by arrows 156. The gripping device 104 is aligned relative to the actuation member 106 such that the protrusions 128 of the gripping device 104 pass through the channels 132 formed between adjacent projections 130. Thus, the protrusions 128 act as keys and the channels 132 act as keyways. Likewise, the projections 130 of the actuation member 106 pass through the channels 152 formed between adjacent protrusions 128. Thus, the projections 130 act as keys and the channels 152 act as keyways.

Inasmuch as the protrusions 128, projections 130, channels 132 and 152, etc., are all cooperatively oriented at 90 degree intervals about the longitudinal axis of the knob attachment assembly 100, the gripping device 104 may be selectively coupled to the actuation member 106 in various orientations. More specifically, the installer of the gripping device 104 may selectively rotate the gripping device 104 in 90 degree increments to select between one of four orientations to install the gripping device 104. Once a desired orientation of the gripping device 104 is selected, the gripping device 104 is inserted upon the actuation member 106 from the uninstalled position of the gripping device 104 depicted in FIG. 4 to the unlocked position of the gripping device 104 pictured in FIG. 2.

The preferred orientation of the gripping device 104 prior to insulation upon the actuation member 106 is such that any indicia 116 (See FIG. 1) present on the gripping device 104 is oriented about 45 degrees counterclockwise (from the perspective of one looking at the indicia) from the final desired orientation of the indicia. Thus, when the gripping device 104 is rotated from the unlocked position depicted in FIG. 2 to the locked position depicted in FIG. 3, which involves about a 45 degree clockwise rotation of the gripping device 104, the indicia is oriented as desired.

Figure 3:
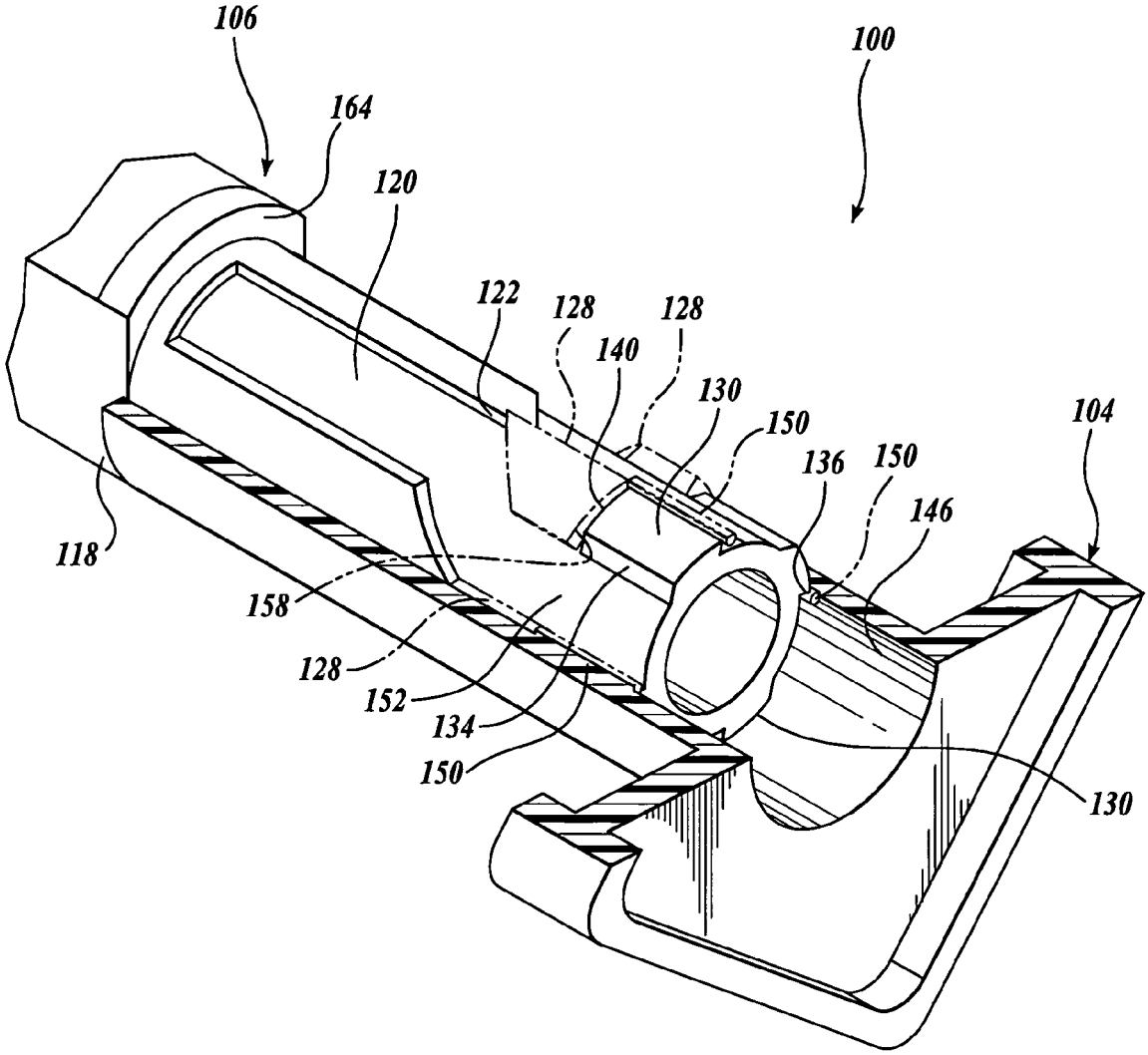
FIG. 3 is a perspective view of the knob attachment assembly shown in FIG. 2 depicted with the gripping device in a locked position, the gripping device held in the locked position at least in part by interaction of the protrusions with the limit stops and the projections, and the locking members' engagement with the projections.

Referring to FIGS. 2 and 3, the process of transitioning the gripping device 104 from the unlocked position depicted in FIG. 2 to the locked position depicted in FIG. 3 will now be described. To transition the gripping device 104 from the unlocked position to the locked position, the gripping device 104 is rotated approximately 45 degrees in the direction of arrow 138. As the gripping device 104 is rotated, the locking members 150 engage the projections 130 and pass from the leading sidewalls 134 to the trailing sidewalls 136 of the projections 130. As the locking members 150 pass over the top surface of the projections 130, the locking members 150 are compressed between the top surface of the projections 130 and the main body 146 of the gripping device 104. The incline of the leading sidewalls 134 aids the passage of the locking members 150 over the projections 130. Contrarily, the incline of the trailing sidewalls 136 creates a sharp edge or tooth that tends to hold the locking member 150 to maintain the gripping device 104 in the locked position.

As the gripping device 104 is rotated from the unlocked position to the locked position, the protrusions 128 are rotated until they engage the limit stops 122. The limit stops 122, as their name implies, limit the angular displacement of the gripping device 104. Of importance, the limit stops 122 are located so as to engage the protrusions 128 as the locking members 150 engage the trailing sidewalls 136 of the projections 130.

Further, as the gripping device 104 is rotated from the unlocked position to the locked position, the engagement surfaces 140 of the projections 130 engage the interference surfaces 158 of the protrusions 128 in an interference relationship. More specifically, as the rotating of the gripping device 104 from the unlocked to the locked position occurs, the separation angle 142 of the two surfaces results in the engagement and compression of the engagement surfaces 140 upon the interference surfaces 158.

Thus, when the gripping device 104 is in the locked position shown in FIG. 3, the gripping device 104 is impeded from movement from the locked position. More specifically, the gripping device 104 is impeded from moving in the direction of arrow 138 at least by the engagement of the protrusions 128 against the limit stops 150 and by the interference fit of the engagement surfaces 140 against the interference surfaces 158. The gripping device 104 is impeded from moving in a direction opposite of arrow 138 at least by the engagement of the locking members 150 with the trailing sidewalls 136 of the projections 130 and by the interference fit of the engagement surfaces 140 against the interference surfaces 158. The gripping device is impeded from moving in the direction of arrows 156 by engagement of the proximal end 162 of the gripping device 104 against the shoulder 164 on the base 118 of the actuation member 106. The gripping device is impeded from moving in the direction opposite of arrow 156 by engagement of the engagement surfaces 140 against the interference surfaces 158.

Of note, the gripping device 104, once placed in the locked position, may be selectively removed from the locked position. Thus, the gripping device 104 may be gripped and rotated by the user in a direction opposite of that indicated by arrow 138 to rotate the gripping device from the locked position to the unlocked position. Due to the incline of the trailing sidewalls 136, which increases the hold the trailing sidewalls 136 exert upon the locking members 150, the force required to rotate the gripping device 104 from the locked position to the unlocked position is greater than the force required to rotate the gripping device 104 form the unlocked position to the locked position.

If the user wishes to remove the gripping device 104, such as to reorientate the indicia 116 or to permit removal of the control device 102 from the backside of the control panel 108, the user simply grasps the gripping device 104 and rotates the gripping device opposite of that indicated by arrow 138 to the unlocked position. Once in the unlocked position, the user pulls in the opposite direction indicated by arrow 156, removing the gripping device 104 from the actuation member 106. If the gripping device was removed to reorientate the gripping device 104, the gripping device is reoriented by rotating the gripping device 104 in 90 degree increments and then reinserted upon the actuation member 106.

Figure 5:
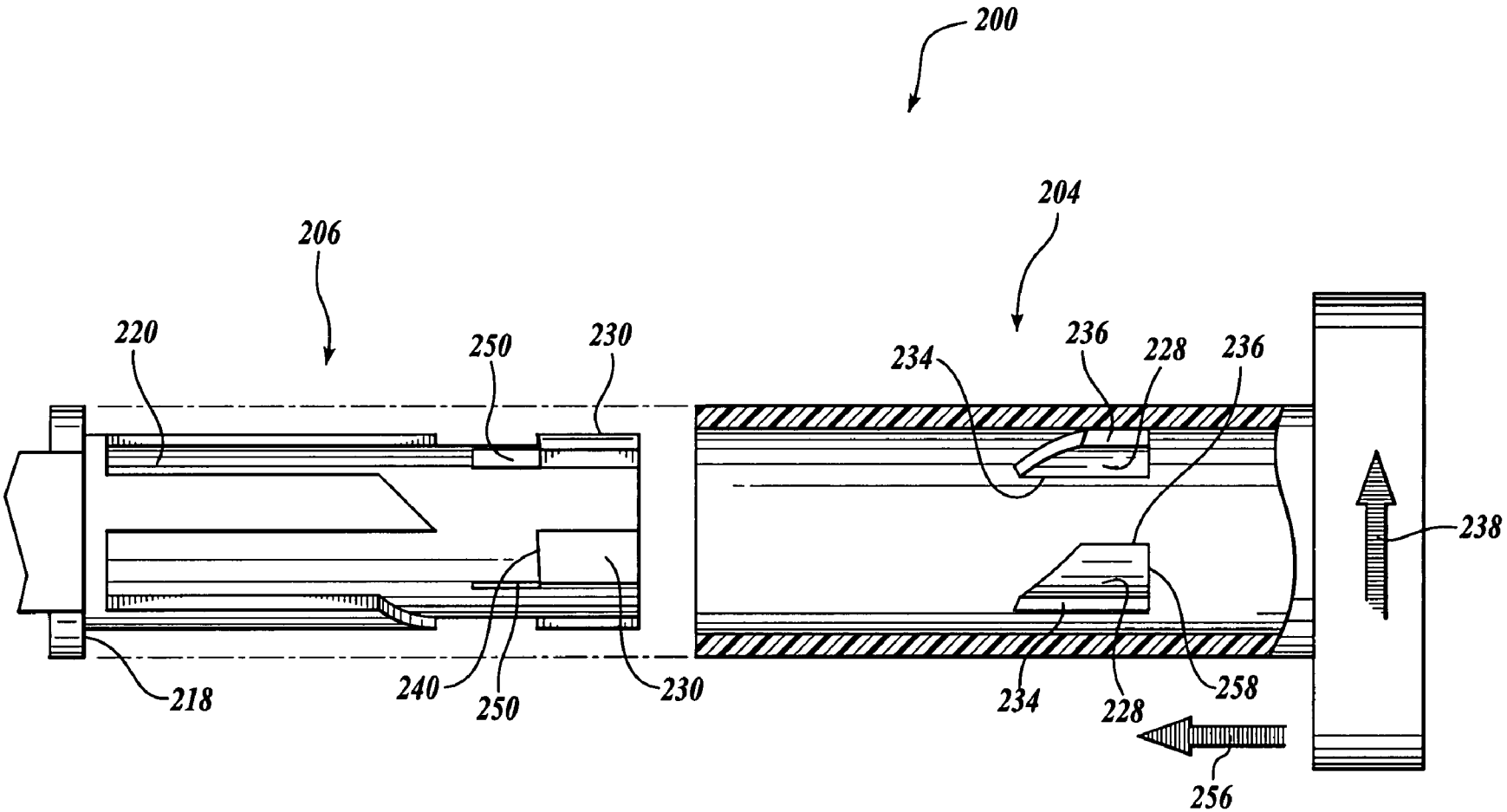
FIG. 5 is a partial exploded elevation view of an alternate embodiment of a knob attachment assembly formed in accordance with the present invention wherein a portion of a gripping device has been removed to show a series of protrusions disposed in an inner cavity of the gripping device, the alternate embodiment substantially identical to the knob attachment assembly depicted in FIGS. 1-4 with the exception that a series of locking members are disposed on an actuation member instead of upon the gripping device.

Referring to FIG. 5, an alternate embodiment of a knob attachment assembly 200 formed in accordance with the present invention is depicted. The knob attachment assembly 200 of FIG. 5 is substantially similar to the knob attachment assembly 100 depicted in FIGS. 1-4 with a few exceptions. Inasmuch as the alternate embodiment depicted in FIG. 5 is substantially similar to the above described embodiment, this detailed description will focus only on the distinguishing differences for the sake of brevity.

The first distinguishing difference between the embodiments is that the alternate embodiment of FIG. 5 has a series of locking members 250 disposed on a main body 220 of an actuation member 206, instead of upon a gripping device 204, as was done in the embodiment of FIGS. 1-4. Further, the leading sidewalls 234 and trailing sidewalls 236 of a series of protrusions 228 are inclined in the same manner as the leading and trailing sidewalls 134 and 136 of the projections 130 of the embodiment of FIGS. 1-4.

In operation, the gripping device 204 is received by the actuation member 206. The gripping device 204 is rotated from an unlocked position to a locked position as described above for the embodiment of FIGS. 1-4. As the gripping device 204 is rotated, the leading edges 234 of the protrusions 228 engage the locking members 250. As the gripping device 204 is rotated further towards the locked position, the locking members 250 are compressed between the outer surface of the protrusions 228 and the main body 220 of the actuation member 206 as the locking members 250 pass underneath the protrusions 228.

When the gripping device 204 is rotated into the locked position, the gripping device 204 is held in the locked position. More specifically, the gripping device 204 is impeded from moving in the direction of arrow 238 by the engagement of the protrusions 228 against the limit stops 252 and by the interference fit of the interference surfaces 258 of the protrusions 228 against the engagement surfaces 240 of the projections 230. The gripping device 204 is impeded from movement in the direction opposite of the direction indicated by arrow 238 at least by the engagement of the locking members 250 with the trailing sidewalls 236 of the protrusions 228 and by the interference fit of the interference surfaces 258 against the engagement surfaces 240. The gripping device is also impeded from moving in the direction of arrow 256 by engagement of the proximal end of the gripping device 204 against the base 218 of the actuation member 206. The gripping device is also impeded from moving by engagement of the engagement surfaces 240 against the interference surfaces 258 from moving in the direction opposite of the direction indicated by arrow 256.

Although the protrusions, projections, channels, etc. are disposed about the center axis of the above described knob attachment assemblies 100 and 200 in 90 degree intervals, it should be apparent that these items may be spaced about the center axis in alternate and/or variable intervals. For instance, if 6 protrusions are used, then the protrusions may be evenly divided about the center axis in 30 degree intervals to provide enhanced adjustability to the orientation of the gripping device upon the actuation member. Further, although the protrusions are described as equally spaced about the center axis, it should be apparent to those skilled in the art that the interval may be varied, such that between a first set of adjacent protrusions, a separation angle of 50 degrees exist, and between a second set of adjacent protrusions, 40 degrees. Therefore, it should be apparent to those skilled in the art that both the quantities of protrusions, projections, channels, etc may be varied, such as from one and greater, without departing from the present invention. Likewise, the angles separating like components may be varied without departing from the spirit and scope of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A knob attachment assembly comprising:

a control device housing;

an actuation member coupled to the control device housing, the actuation member including a first engagement surface and a central axis; and a gripping device including a first interference surface, the gripping device being selectively couplable to the actuation member and rotatable about the central axis of the actuation member between a locked position, wherein interference of the first engagement surface with the first interference surface couples the gripping device to the actuation member and holds the gripping device in the locked position, and an unlocked position, wherein the gripping device is removable from the actuation member.

2. The knob attachment assembly of claim 1, wherein the gripping device includes a key and the actuation member includes a first keyway and a second keyway, wherein the gripping device may be selectively coupled upon the actuation member in either a first orientation or a second orientation by selectively interfacing the key with the first keyway or the second keyway.

3. The knob attachment assembly of claim 1, wherein the first engagement surface is inclined relative to the first interference surface by a selected separation angle.

4. The knob attachment assembly of claim 3, wherein the selected separation angle is between about 1 degree and about 10 degrees.

5. The knob attachment assembly of claim 1, further comprising a locking member coupled to the gripping device or the actuation member, the locking member positioned to engage a first projection disposed on the actuation member or a first protrusion disposed on the gripping device to aid in holding the gripping device in the locked position.

6. The knob attachment assembly of claim 5, wherein the locking member is disposed upon the gripping device or the actuation member so as to be compressed against the first projection or the first protrusion as the gripping device is transitioned from the locked position to the unlocked position.

7. The knob attachment assembly of claim 5, further comprising a sidewall surface coupled to either the first projection or the first protrusion, the sidewall surface adapted to engage the locking member when the gripping device is in the unlocked position, wherein the sidewall surface is inclined relative to a plane passing through a center axis of the actuation member.

8. The knob attachment assembly of claim 5, further comprising an additional locking member coupled to the gripping device or the actuation member, the additional locking member positioned to engage a second projection disposed on the actuation member or a second protrusion disposed on the gripping device to aid in holding the gripping device in the locked position.

9. The knob attachment assembly of claim 1, further comprising a limit stop coupled to the actuation member, the limit stop positioned to engage a first protrusion disposed on the gripping device to aid in holding the gripping device in the locked position.

10. The knob attachment assembly of claim 9, further comprising an additional limit stop coupled to the actuation member, the additional limit stop positioned to engage a second protrusion disposed on the gripping device when the gripping device is in the locked position to aid in holding the gripping device in the locked position.

11. The knob attachment assembly of claim 1, further comprising;

a second engagement surface disposed on the actuation member;

a second interference surface disposed on the gripping device; and wherein when the gripping device is in the locked position, the gripping device is additionally coupled to the actuation member by interference of the second engagement surface with the second interference surface.

12. The knob attachment assembly of claim 1, wherein the first engagement surface is inclined relative to the first interference surface by a selected separation angle, wherein the separation angle is selected so that, as the gripping device is rotated relative to the actuation member, the resistance to rotation varies according to the engagement between the first engagement surface and the first interference surface.

13. A knob attachment assembly comprising:

a control device;

an actuation member coupled to the control device, the actuation member including a central axis and having a first projection with a first engagement surface; and a gripping device having a first protrusion with a first interference surface, wherein the gripping device is adapted to be selectively keyed upon the actuation member in a first orientation or a second orientation by selective interaction of the first projection with the first protrusion, and wherein the gripping device is selectively couplable to the actuation member and is rotatable about the central axis of the actuation member between a locked position, wherein interference of the first engagement surface with the first interference surface couples the gripping device to the actuation member and holds the gripping device in the locked position, and an unlocked position, wherein the gripping device is selectively removable from the actuation member.

14. The knob attachment assembly of claim 13, wherein the first engagement surface is inclined relative to the first interference surface by a selected separation angle.

15. The knob attachment assembly of claim 14, wherein the selected separation angle is between about 1 degree and about 10 degrees.

16. The knob attachment assembly of claim 13, further comprising a locking member coupled to the gripping device or the actuation member, the locking member positioned to engage a first projection disposed on the actuation member or a first protrusion disposed on the gripping device to aid in holding The gripping device in the locked position.

17. The knob attachment assembly of claim 16, wherein the locking member is disposed upon the gripping device or the actuation member so as to be compressed against the first projection or the first protrusion as the gripping device is transitioned from the locked position to the unlocked position.

18. The knob attachment assembly of claim 16, further comprising a sidewall surface coupled to either the first projection or the first protrusion, the sidewall surface adapted to engage the locking member when the gripping device is in the unlocked position, wherein the sidewall surface is inclined relative to a plane passing through a center axis of the actuation member.

19. The knob attachment assembly of claim 16, further comprising an additional locking member coupled to the gripping device or the actuation member, the additional locking member positioned to engage a second projection disposed on the actuation member or a second protrusion disposed on the gripping device to aid in holding the gripping device in the locked position.

20. The knob attachment assembly of claim 13, further comprising a limit stop coupled to the actuation member, the limit stop positioned to engage the first protrusion to aid in holding the gripping device in the locked position.

21. The knob attachment assembly of claim 20, further comprising an additional limit stop coupled to the actuation member, the additional limit stop positioned to engage a second protrusion disposed on the gripping device when the gripping device is in the locked position to aid in holding the gripping device in the locked position.

22. The knob attachment assembly of claim 13, further comprising:

a second engagement surface disposed on the actuation member;

a second interference surface disposed on the gripping device; and wherein when the gripping device is in the locked position, the gripping device is additionally coupled to the actuation member by interference of the second engagement surface with the second interference surface.

23. The knob attachment assembly of claim 13, wherein the first engagement surface is inclined relative to the first interference surface by a selected separation angle, wherein the separation angle is selected so that, as the gripping device is rotated relative to the actuation member, the resistance to rotation varies according to the engagement between the first engagement surface and the first interference surface.

24. A knob attachment assembly comprising:

an actuation member having a central axis, the actuation member including a limit stop and a first projection;

a gripping device having a first protrusion;

a locking member coupled to either the actuation member or the gripping device; and wherein the gripping device is adapted to be selectively keyed upon the actuation member in either a first orientation or a second orientation by selectively interfacing of the first projection with the first protrusion, and wherein the gripping device is selectively couplable to the actuation member and is rotatable about the central axis of the actuation member between a locked position, wherein engagement of the first protrusion against the limit stop and engagement of the locking member against the first projection or the first protrusion couple the gripping device to the actuation member and hold the gripping device in the locked position, and an unlocked position, wherein the gripping device is selectively removable from the actuation member.

25. The knob attachment assembly of claim 24, wherein the first projection includes a first engagement surface and the first protrusion includes a first interference surface, wherein the gripping device is coupled to the actuation member by interference of the first engagement surface and the first interference surface when the gripping device is in the locked position.

26. The knob attachment assembly of claim 25, wherein the first engagement surface is inclined relative to the first interference surface by a selected separation angle.

27. The knob attachment assembly of claim 26, wherein the selected separation angle is between about 1 degree and about 10 degrees.

28. The knob attachment assembly of claim 25, further comprising:

a second engagement surface disposed on the actuation member;

a second interference surface disposed on the gripping device; and wherein when the gripping device is in the locked position, the gripping device is additionally coupled to the actuation member by interference of the second engagement surface with the second interference surface.

29. The knob attachment assembly of claim 25, wherein the first engagement surface is inclined relative to the first interference surface by a selected separation angle, wherein the separation angle is selected so that, as the gripping device is rotated relative to the actuation member, the resistance to rotation varies according to the engagement between the first engagement surface and the first interference surface.

30. The knob attachment assembly of claim 24, wherein the locking member is disposed upon the gripping device or the actuation member so as to be compressed against the first projection or the first protrusion as the gripping device is transitioned from the unlocked position to the locked position.

31. The knob attachment assembly of claim 24, further comprising a sidewall surface coupled to the either the first projection or the first protrusion, the sidewall surface adapted to engage the locking member when the gripping device is in the unlocked position.

32. The knob attachment assembly of claim 24, further comprising, an additional locking member coupled to the gripping device or the actuation member, the additional locking member positioned to engage a second projection disposed on the actuation member or a second protrusion disposed on the gripping device to aid in holding the gripping device in the locked position.

33. The knob attachment assembly of claim 24, further comprising an additional limit stop coupled to the actuation member, the additional limit stop positioned to engage a second protrusion disposed on the gripping device when the gripping device is in the locked position to aid in holding the gripping device in the locked position.

* * * * *